US010184239B2

(12) United States Patent
Meincke et al.

(10) Patent No.: US 10,184,239 B2
(45) Date of Patent: Jan. 22, 2019

(54) COVERING CONSISTING OF A PLURALITY OF GRATINGS INSERTED ONE INTO ANOTHER

(75) Inventors: Arne Meincke, Osdorf (DE); Hans-Julius Ahlmann, Büdelsdorf (DE)

(73) Assignee: ACO SEVERIN AHLMANN GMBH & CO. KG, Rendsburg (DE)

( * ) Notice: Subject to any disclaimer, the term of this patent is extended or adjusted under 35 U.S.C. 154(b) by 644 days.

(21) Appl. No.: 13/817,475

(22) PCT Filed: Aug. 16, 2011

(86) PCT No.: PCT/EP2011/064112

§ 371 (c)(1),
(2), (4) Date: Mar. 11, 2013

(87) PCT Pub. No.: WO2012/022753

PCT Pub. Date: Feb. 23, 2012

(65) Prior Publication Data

US 2013/0161246 A1 Jun. 27, 2013

(30) Foreign Application Priority Data

Aug. 19, 2010 (DE) ..... 10 2010 037 081
Sep. 15, 2010 (DE) ..... 10 2010 037 563

(51) Int. Cl.
*E03F 5/06* (2006.01)
*E04C 2/42* (2006.01)

(52) U.S. Cl.
CPC ..... *E03F 5/06* (2013.01); *E04C 2/421* (2013.01); *E03F 2005/068* (2013.01)

(58) Field of Classification Search
None
See application file for complete search history.

(56) References Cited

U.S. PATENT DOCUMENTS 1,426,736 A * 8/1922 Hess ..... E04C 2/425 5/264.1
1,428,230 A * 9/1922 Hess ..... E04C 2/425 105/457

(Continued)

FOREIGN PATENT DOCUMENTS

CN 1112035 A 11/1995
CN 1150204 A 5/1997

(Continued)

OTHER PUBLICATIONS

English translation of first Office Action for Chinese Patent Application No. 201180039370.0, dated Nov. 15, 2013, 7 pages.

(Continued)

*Primary Examiner* — Robert J Popovics
(74) *Attorney, Agent, or Firm* — Westman, Champlin & Koehler, P.A.

(57) ABSTRACT

Covers for drains, manholes or similar constructions are known which comprise a first grate (10) made of sheet metal and comprising slots (11) and struts (12), said struts having top faces (13) and each strut having side faces (14, 14') made of sheet metal bent with respect to the top face. In order to increase the rigidity it is proposed that at least a second grate (20) is provided, the struts (22) of which are inserted in the slots (11) of the first grate (10).

8 Claims, 4 Drawing Sheets

(56) References Cited

U.S. PATENT DOCUMENTS 2,031,779 A * 2/1936 Ladd ..... B21D 47/005 52/668
2,084,118 A * 6/1937 Zabriskie ..... E04C 2/425 52/667
2,396,735 A * 3/1946 Leigh ..... E04C 2/423 52/656.8
3,645,510 A * 2/1972 Klugman ..... E04C 2/427 261/94
3,864,887 A * 2/1975 Arens ..... E04F 19/10 4/506
3,943,675 A * 3/1976 Wyss ..... B21D 47/005 52/177
4,522,009 A * 6/1985 Fingerson ..... E04C 2/425 156/293
5,024,550 A * 6/1991 Mainville ..... E03F 5/06 210/163
5,203,544 A * 4/1993 Webb ..... A01K 3/002 119/843
D339,415 S * 9/1993 Kiras ..... D23/397
5,261,433 A * 11/1993 Smith ..... B60S 3/042 134/123
5,383,742 A * 1/1995 Grace ..... E01C 9/083 238/14
D374,727 S * 10/1996 Emanuele ..... D25/152
D410,709 S * 6/1999 Edwards ..... D21/561
6,358,330 B1 * 3/2002 McGraw ..... B60S 3/042 134/104.4
6,908,256 B1 * 6/2005 Humphries ..... E03F 5/06 210/163
6,942,419 B2 * 9/2005 Knak ..... E03F 5/06 210/163
7,163,351 B1 * 1/2007 Shaver ..... B60S 3/042 15/53.1
7,891,507 B2 * 2/2011 Shetler ..... A47B 47/02 211/135
7,931,421 B2 * 4/2011 Rathmann ..... E03F 5/06 404/2
8,075,219 B2 * 12/2011 Greville ..... E03F 5/06 404/2
8,132,385 B2 * 3/2012 Phillips ..... E04C 2/427 119/509
9,745,733 B2 * 8/2017 Ahlmann ..... E03F 3/046
2009/0159545 A1 * 6/2009 Shetler ..... A47B 55/00 211/153
2010/0008719 A1 * 1/2010 Rathmann ..... E03F 5/06 404/4
2013/0161246 A1 * 6/2013 Meincke ..... E03F 5/06 210/163
2015/0240470 A1 * 8/2015 Ahlmann ..... E03F 3/046 404/4

FOREIGN PATENT DOCUMENTS

CN 101215852 A 7/2008
CN 101631917 A 1/2010
DE 10202652 A1 7/2003
DE 102006051160 A1 5/2008
EP 0 672 800 A2 9/1995
JP 2003-096899 A 4/2003
JP 2009250026 A 10/2009
WO 20070141035 A1 12/2007
WO 20080052599 A1 5/2008
WO 20100021472 A2 2/2010
WO WO-2012000738 A1 * 1/2012 ..... B21D 43/02

OTHER PUBLICATIONS

English translation of International Preliminary Report on Patentability and Written Opinion for PCT Application No. PCT/EP2011/064112, dated Feb. 19, 2013, 8 pages.
Office Action from Australian patent application No. 2011290762, dated May 18, 2015.
International Search Report and Written Opinion for PCT Application No. PCT/EP2011/064112, dated Oct. 26, 2011.
Office Action for DE Application 102010037563.2, dated Jul. 18, 2011.

* cited by examiner

COVERING CONSISTING OF A PLURALITY OF GRATINGS INSERTED ONE INTO ANOTHER

CROSS-REFERENCE TO RELATED APPLICATION

This Application is a Section 371 National Stage Application of International Application No. PCT/EP2011/064112, filed Aug. 16, 2011 and published as WO 2012/022753 A 1 on Feb. 23, 2012, in German, the contents of which are hereby incorporated by reference in their entirety.

DESCRIPTION

The invention relates to a cover for drains, manholes or similar constructions according to the preamble of claim 1.

Outdoors or indoors, it is often necessary to cap holes in such a way that it is possible to tread or drive safely thereover. In many cases, e.g. for the purpose of surface drainage, such covers contain orifices which the surface water can enter in order then to be carried away. In the simple case, such covers are bent from sheet metal as grates, which are provided with slots and struts. The struts have top faces and side faces that are bent with respect to the top face. Such grates are made from a single strip of sheet metal, in which the material is severed between the struts and bent downwards so as to produce the side faces. The height of the side face thus equals half the gap between two struts, in other words half the width of the slots. Since the width of the slots is limited, only a certain maximum height of the side faces is thus available, which limits the rigidity of the grates. In order to increase the rigidity of said grates, a stronger material must be chosen, which in turn increases the costs of such grates significantly. A grate of this type is known from WO 2008/052599 A1 for example.

The object of the invention is to develop a cover of the type mentioned in the introduction in such a way that increased rigidity can be achieved without increasing the material thickness.

This object is achieved by a cover according to claim 1. In particular this object is achieved in that at least a second grate is provided, the struts of which are inserted in the slots of the first grate. This means that each of the two grates (if initially just two grates are assumed) can have twice the slot width, which in turn results in the height of the side faces of each strut being exactly twice as high as for the "normal" slot width. Greater rigidity can thereby be achieved for the same material thickness despite a small slot width (as is stipulated).

The first grate is preferably connected to the second grate and to any further grates that are required, and preferably connected non-detachably. This produces a cover that can be handled as one piece.

When the first grate is connected by interlocking to the second grate and to any further grates that are required, then a single-piece part can be created with little effort involved.

The first grate is preferably connected by edge folds to the second grate and to any further grates that are required. This produces a very compact part because the grates rest anyway by their edges on appropriate frames or top edges of the manholes or constructions to be covered.

The struts of the grates are preferably bent such that the top faces of said struts lie in one plane. This reduces the risk of injury and improves the appearance of the grates.

A particularly high degree of rigidity is obtained when at least one of the grates has downward-projecting edge rims having substantially vertical slots into which the side faces of the struts are hooked. The rigidity of the grates as a whole is increased significantly by supporting the struts at the edge.

Preferably only one of the grates has edge support strips that are bent over in a U-shape, with edge support strips of all further grates interposed, so that said edge support strips of the one grate enclose the "single-layer" support strips of the other grates. This achieves an interlocking connection of all the grates to one another in a particularly low-cost manner.

The previously mentioned embodiments of the invention relate to a grate that rests by its support strips on the edge of a drain. The present invention, however, is also suitable for grates that are inserted between frames of a drain. In this case the grates have C-shaped or hook-shaped edge folds, the open side of which faces inwards, in which folds the struts are supported. Otherwise the essential construction features, i.e. the interlocking connection of a plurality of grates, remain the same.

Such grates are preferably produced by roll-forming.

Preferred embodiments of the invention appear in the exemplary embodiments, which are described in greater detail below with reference to drawings, in which.

Figure 1A:
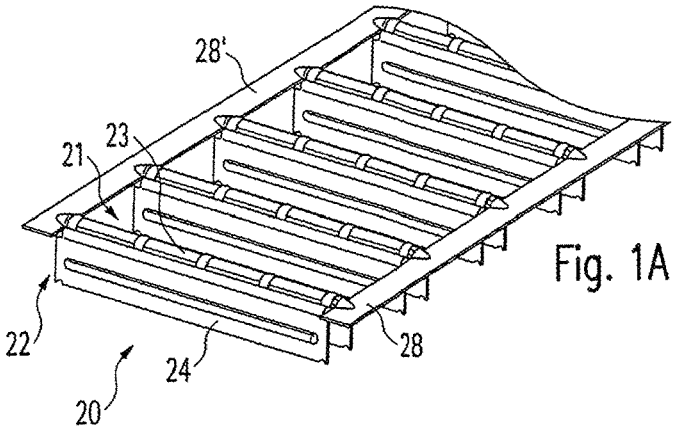
FIG. 1A shows a perspective partial view of a second grate.
Figure 1B:
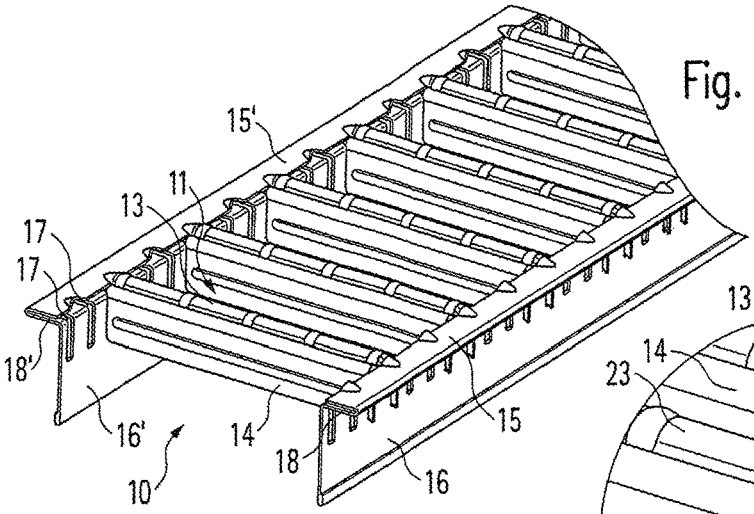
FIG. 1B shows a perspective partial view of a first grate.
Figure 2:
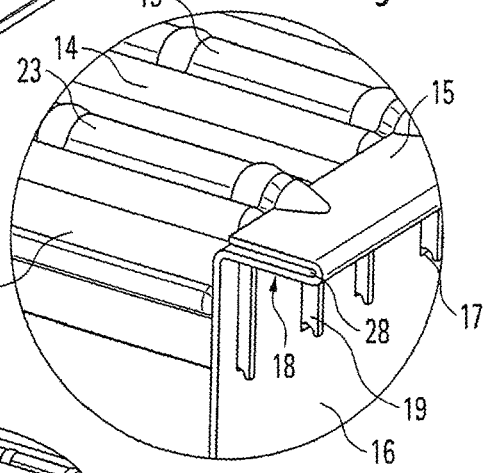
Figure 1C:
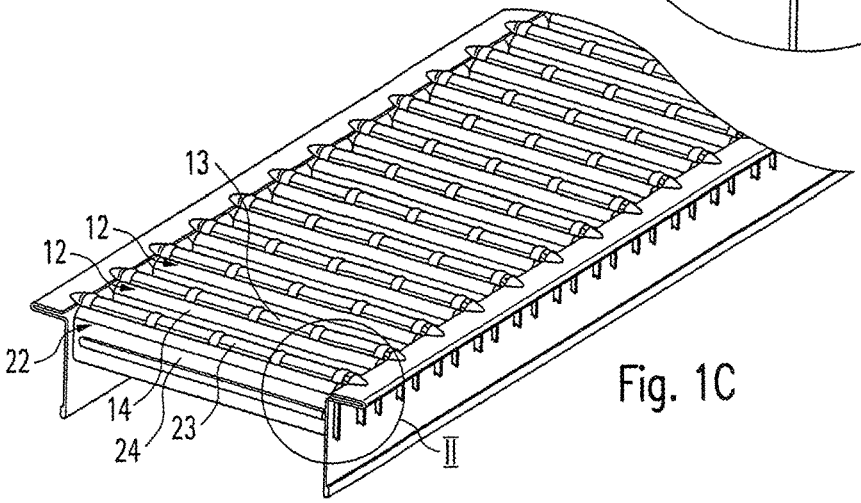
Figure 3:
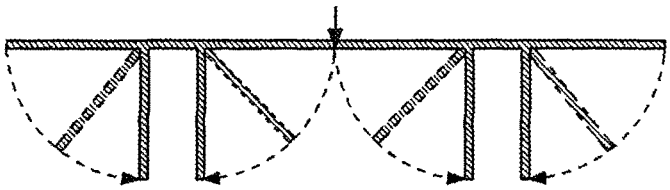
Figure 4:
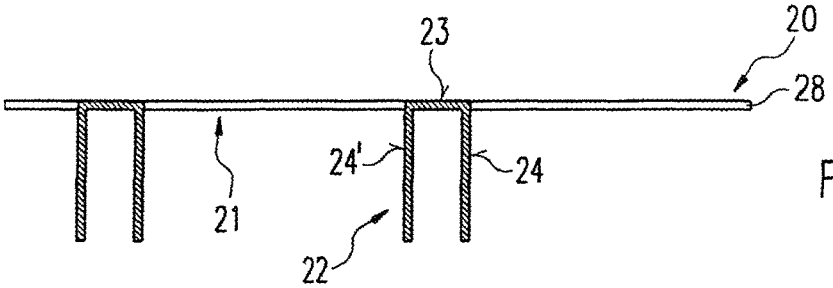
Figure 5:
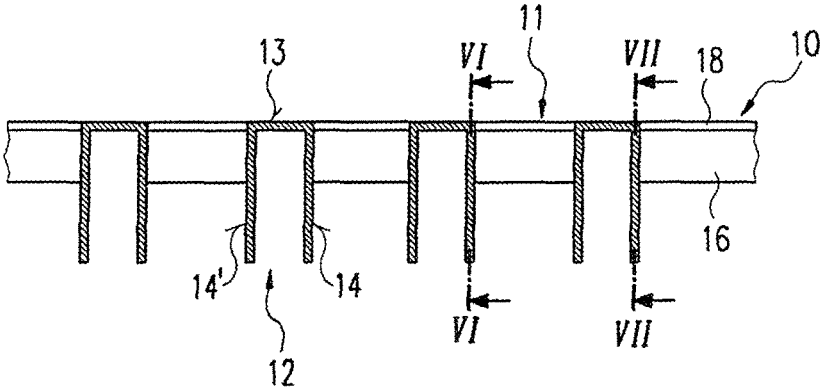
Figure 6:
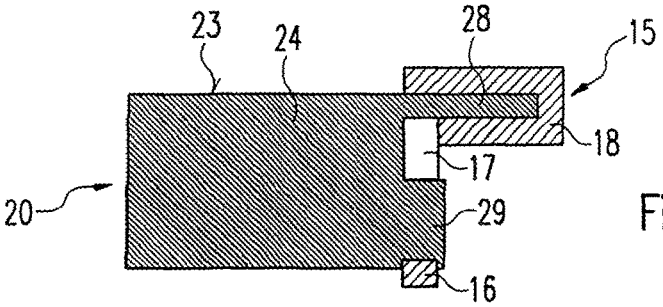
Figure 7:
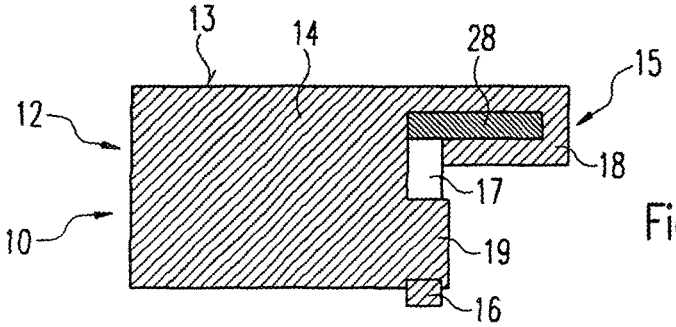
Figure 8:
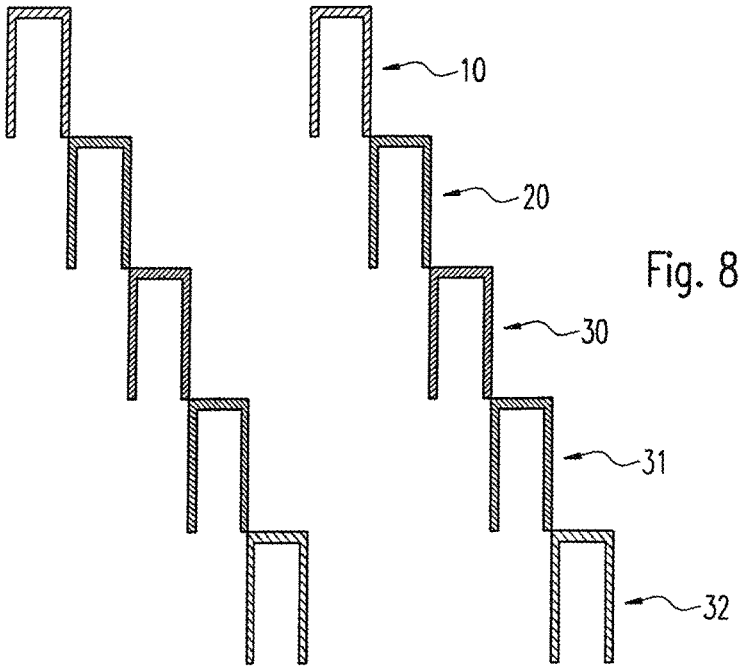
Figure 9:
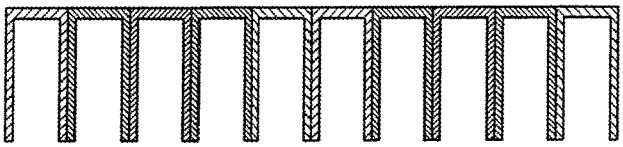
Figure 10:
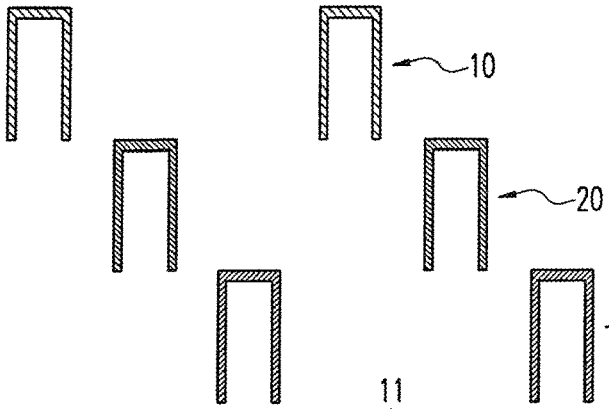
Figure 11:
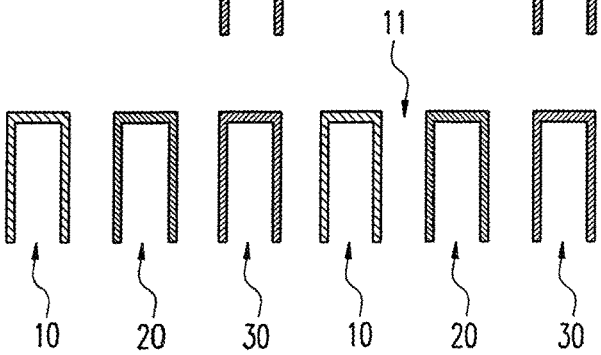
Figure 12:
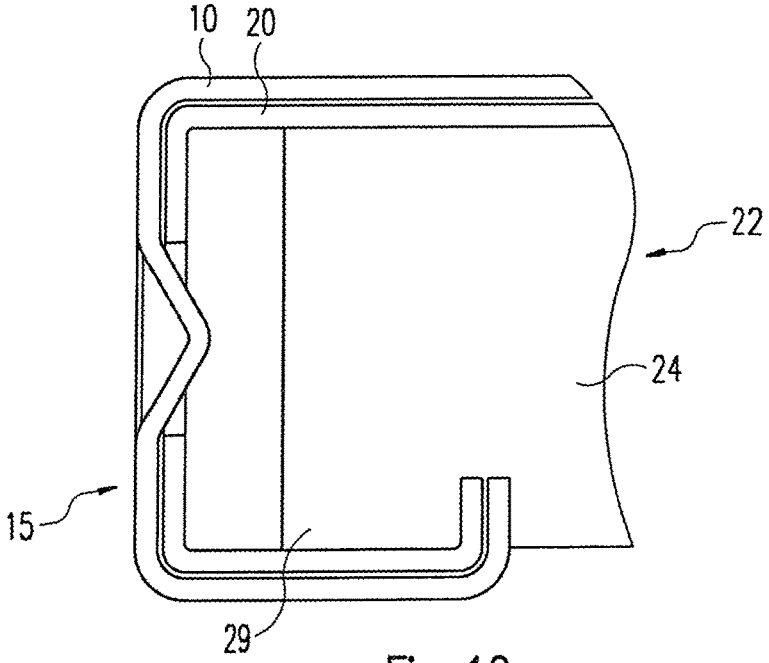
Figure 13:
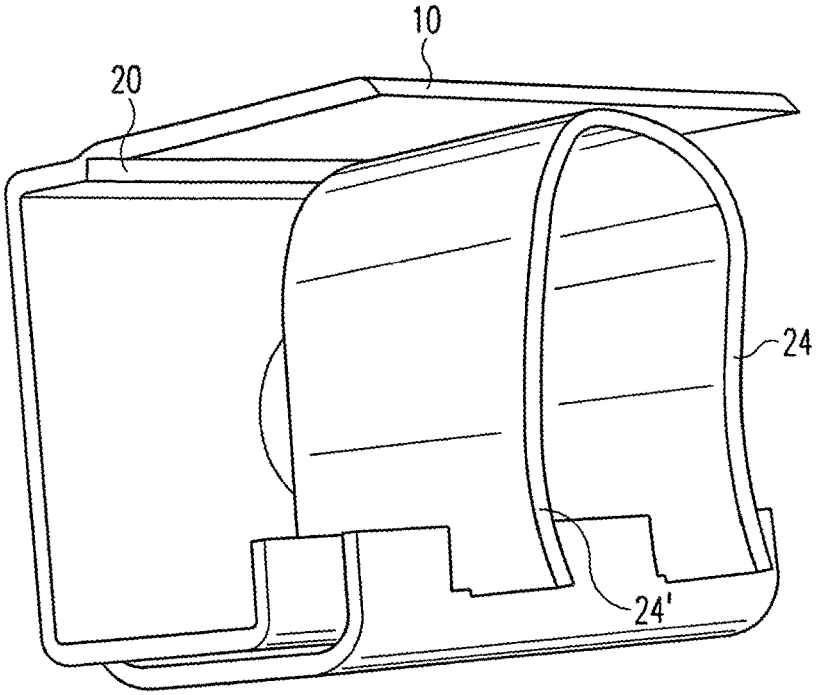

FIG. 1C shows the grates according to FIGS. 1A and 1B connected together, FIG. 2 shows a magnified view of the detail labelled II in FIG. 1C, FIG. 3 shows a schematic view of a longitudinal section for the purpose of explaining the stamping and bending process for producing a grate, FIG. 4 shows a diagram of a longitudinal section of a second grate, FIG. 5 shows a diagram of a longitudinal section through a complete grate, FIG. 6 shows a partial cross-section along the line VI-VI in FIG. 5, FIG. 7 shows a partial cross-section along the line VII-VII in FIG. 5, FIG. 8 shows diagrams of longitudinal sections through five individual grates to be connected together, FIG. 9 shows the five grates of FIG. 8 for forming a fully closed cover, FIG. 10 shows a diagram similar to that of FIG. 8 but containing only three grates, FIG. 11 shows the three grates of FIG. 10 assembled into a single grate, FIG. 12 shows a partial face-on view of a further embodiment of the invention, and FIG. 13 shows a perspective view of the embodiment of FIG. 12.

In the following description, the same reference numbers are used for parts that are identical and work in the same way.

An embodiment of the invention is described below with reference to FIGS. 1 and 2.

FIG. 1B shows a first grate, which is produced from a single piece of sheet metal by roll-forming or stamping. This first grate 10 comprises struts 12, which are separated by slots 11.

Each strut 12 has a top face, which is provided with bumps to improve the slip resistance when walked on. Directed downwards from the top faces 13, the struts 12 have side folds 14, 14', which engage by end claws 19 (FIG. 7) in slots 17, which are stamped in rims 16, 16' so that each side face 14, 14' is supported by their ends in the rims 16, 16'. The top faces 13 are additionally each connected to a top arm of a U shaped fold 15, which, bent downwards, becomes the rims 16, 16'.

It can be seen in FIG. 1B that slots 17 are provided in exactly twice the number than the struts 12. Side faces 24, 24' of struts 22 of a second grate 20 (FIG. 1A) can now be inserted in these slots 17 to produce the finished grate shown in FIG. 1C. This finished grate thus comprises alternately struts 12 and 22 of a first grate 10 and a second grate 20 respectively.

In addition, support strips 28, 28' of the second grate 20 are clamped between the side faces of the U shaped folds 15, 15', and end claws 29 of the side faces 24, 24' are hooked into slots 17 of the rims 16, 16' of the first grate 10.

The advantages of this construction are explained below with reference to FIGS. 3 to 5.

FIG. 3 shows in a highly schematic representation a metal sheet that lies initially in one plane and is then severed in the region of the arrow in FIG. 3. Then the sheet segments are bent downwards, as shown in FIG. 3, to produce a row of struts having very wide slots lying therebetween. FIG. 4 shows such an arrangement, wherein the struts 22 here are inserted centrally between the struts 12 of the grate 10 of FIG. 5. The side faces 14, 14' and 24, 24' can thereby be designed to be twice as high as in a grate that is made of just one sub-piece.

FIGS. 6 and 7 show sections along the lines VI-VI and VII-VII respectively of FIG. 5. These figures show that the first grate 10 has folds 15 along the side, which are bent over in a U-shape and then bent downwards to form the rims 16. These rims 16 comprise slots 17, in which engage end claws 19 of the side faces 14, so that the struts 12 of the first grate 10 are supported by their side faces 14 in the rim 16. In addition, the folds 15 clasp support strips 28 of the second grate 20, which therefore does not have folds 15 and rims 16. This construction guarantees a secure connection between the first grate and the second grate 20 by means of interlocking and also results in the increase in rigidity already explained above by means of higher side faces 14, 14'.

The principle just explained of "interleaving" two grates can also be extended to a larger number of grates. This is shown in FIGS. 8 to 11.

In the embodiment shown in FIG. 8, in addition to a first grate 10 and a second grate 20, three further grates 30 to 32 are shown schematically. These grates can then, as shown in FIG. 9, be "stacked" inside one another so as to produce a completely closed cover, which, however, is produced "only" from formed sheet-metal parts and yet has an extraordinarily high degree of rigidity.

In the embodiment shown in FIGS. 10 and 11, a first grate 10, a second grate 20 and a third grate 30 are fitted inside one another to produce relatively narrow slots 11, as is sometimes required. Furthermore, the rigidity of this arrangement is likewise especially high.

FIG. 1 and FIGS. 6 and 7 have been used to describe grates that rest by their support strips 18, 18'; 28, 28' on edges of a drain. FIGS. 12 and 13 show schematically grates that lie between frames of a drain. For this purpose, the folds 15 have a C-shaped or hook-shaped design and define the thickness of the grates 10, 20. The struts 22, or more precisely the side faces 24, 24' of same, protrude by their end claws 29 into the hook-shaped folds 15 and are supported there. The success achieved hereby is the same as in the embodiment of the invention shown previously. In addition, again two or more grates 10, 20 can be "gripped" inside one another in order to produce thereby a rigid grate that can be handled as a unit.

LIST OF REFERENCES

10 first grate
11 slot
12 strut
13 top face
14, 14' side faces
15, 15' fold
16, 16' rim
17 slot
18, 18' support strip
19 end claw
20 second grate
21 slot
22 strut
23 top face
24, 24' side face
28, 28' support strip
29 end claw
30 third grate
31 fourth grate
32 fifth grate

What is claimed is:

1. Cover for drains or manholes, comprising:

at least one first grate made of a first sheet of sheet metal and comprising slots and struts, said struts having top faces and each strut having at least one side face made of a portion of the first sheet of sheet metal which is bent with respect to the top face, the side face having downward-projecting edge rims having substantially vertical slots into which the side faces of the struts are hooked; and at least a second grate made of a second sheet of sheet metal and comprising slots and struts having top faces and each strut having at least one side face made of a portion of the second sheet of sheet metal which is bent with respect to the top face, the side face comprising support strips to support the struts, the struts of which are inserted in the slots of the first grate, wherein the struts of the grates are bent such that the top faces of said struts lie in one plane.

2. Cover according to claim 1, wherein the first grate is connected by interlocking to the second grate.

3. Cover according to claim 2, wherein the first grate is connected by interlocking to the second grate by folded over tabs of the first grate edge rims.

4. Cover according to claim 1, wherein one of the grates has edge support strips that are bent over in a U-shape, with edge support strips of all the further grates interposed.

5. Cover according to claim 1, wherein the grates are produced by roll-forming.

6. Cover for drains or manholes, comprising:

at least one first grate made of a first sheet of sheet metal and comprising slots and struts, said struts having top faces and each strut having at least one side face made of a portion of the first sheet of sheet metal which is bent with respect to the top face, the side face having downward-projecting edge rims having substantially vertical slots into which the side faces of the struts are hooked; and at least a second grate made of a second sheet of sheet metal and comprising slots and struts having top faces and each strut having at least one side face made of a portion of the second sheet of sheet metal which is bent with respect to the top face, the side face comprising support strips to support the struts, the struts of which are inserted in the slots of the first grate wherein the first grate is connected to the second grate by interlocking to the second grate, and wherein the first grate is connected by edge folds to the second grate.

7. Cover according to claim 6, wherein the struts of the grates are bent such that the top faces of said struts lie in one plane.

8. Cover for drains or manholes, comprising:

at least one first grate made of a first sheet of sheet metal and comprising slots and struts, said struts having top faces and each strut having at least one side face made of a portion of the sheet metal which is bent with respect to the top face; and at least a second grate made of a second sheet of sheet metal and comprising slots and struts having top faces and each strut having at least one side face made of a portion of the second sheet metal which is bent with respect to the top face, the side face comprising support strips to support the struts, the struts of which are inserted in the slots of the first grate, wherein one of the grates has downward-projecting edge rims having substantially vertical slots into which the side faces of the struts are hooked.

* * * * *